United States Patent [19]

Niggemann et al.

[11] Patent Number: 4,697,427

[45] Date of Patent: Oct. 6, 1987

[54] FORCED FLOW EVAPORATOR FOR UNUSUAL GRAVITY CONDITIONS

[75] Inventors: Richard E. Niggemann, Rockford, Ill.; Wilbert E. Ellis, Friendswood, Tex.

[73] Assignee: Sundstrand Corporation, Rockford, Ill.

[21] Appl. No.: 732,874

[22] Filed: May 10, 1985

[51] Int. Cl.[4] ..... F25D 15/00

[52] U.S. Cl. ..... 62/119; 62/383; 62/515; 165/80.2; 361/385

[58] Field of Search ..... 62/515, 119, 383; 361/385; 165/80.1, 80.2, 80.4

[56] References Cited

U.S. PATENT DOCUMENTS

| | | | |
|---|---|---|---|
| 1,041,879 | 10/1912 | Ruffier | 237/12.3 A |
| 1,571,929 | 2/1926 | Bronander | 425/446 |
| 1,815,570 | 7/1931 | Jones | 62/515 |
| 2,538,014 | 1/1951 | Kleist | 62/515 |
| 2,538,016 | 1/1951 | Kleist | 62/515 |
| 2,915,685 | 12/1959 | Diebold | 317/234 |
| 2,992,372 | 7/1961 | Himeon et al. | 317/234 |
| 3,007,088 | 10/1961 | Diebold | 317/234 |
| 3,327,776 | 6/1967 | Butt | 165/80 C |
| 3,651,865 | 3/1972 | Feldmanis | 361/385 |
| 3,656,540 | 4/1972 | Henrici | 62/498 |
| 4,009,423 | 2/1977 | Wilson | 361/385 |
| 4,268,850 | 5/1981 | Lazarek et al. | 165/80 C |
| 4,393,663 | 7/1983 | Grunes | 62/119 |

FOREIGN PATENT DOCUMENTS

| | | | |
|---|---|---|---|
| 1150673 | 1/1956 | France | 62/515 |

OTHER PUBLICATIONS

IBM Technical Disclosure: Chu, R. C., "Counter-Flow Cooling System", vol. 8, No. 11, Apr. 1966.

IBM Technical Disclosure: Christensen, R. G., "Water Cooled Heat Transfer Plate", vol. 23, No. 4, Sep. 1980, pp. 1445–1446.

*Primary Examiner*—Ronald C. Capossela

*Attorney, Agent, or Firm*—Wood, Dalton, Phillips, Mason & Rowe

[57] ABSTRACT

Low efficiency heat transfer in evaporators subject to unusual gravitational conditions is avoided through the use of a spiral evaporator conduit 12 receiving at an inlet 14 a vaporizable coolant at least partly in the liquid phase. Flow of the coolant through the conduit 12 demists the coolant by centrifuging the liquid phase against a pressurre wall 44 of the conduit 12. Vapor flow 40 induces counterrotating vortices 46, 48 which circulate the liquid phase coolant around the interior of the conduit 12 to wet all surfaces thereof.

15 Claims, 12 Drawing Figures

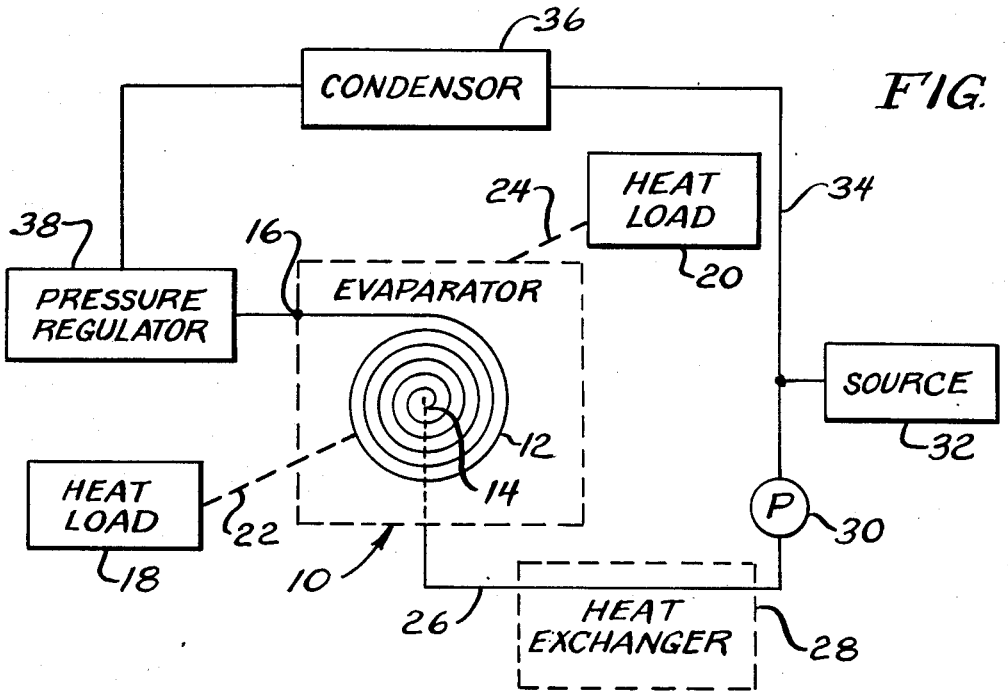
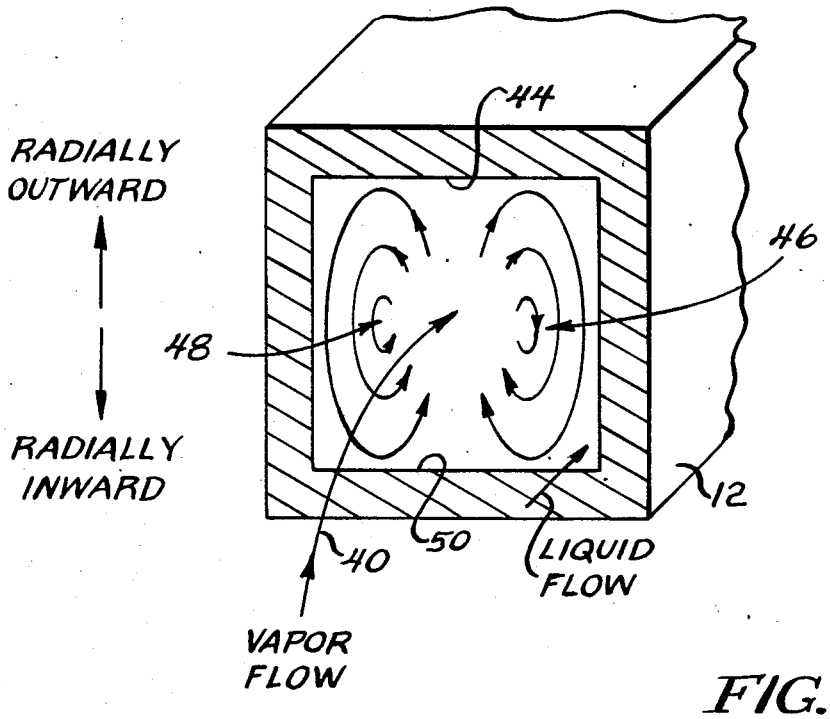
FIG. 2

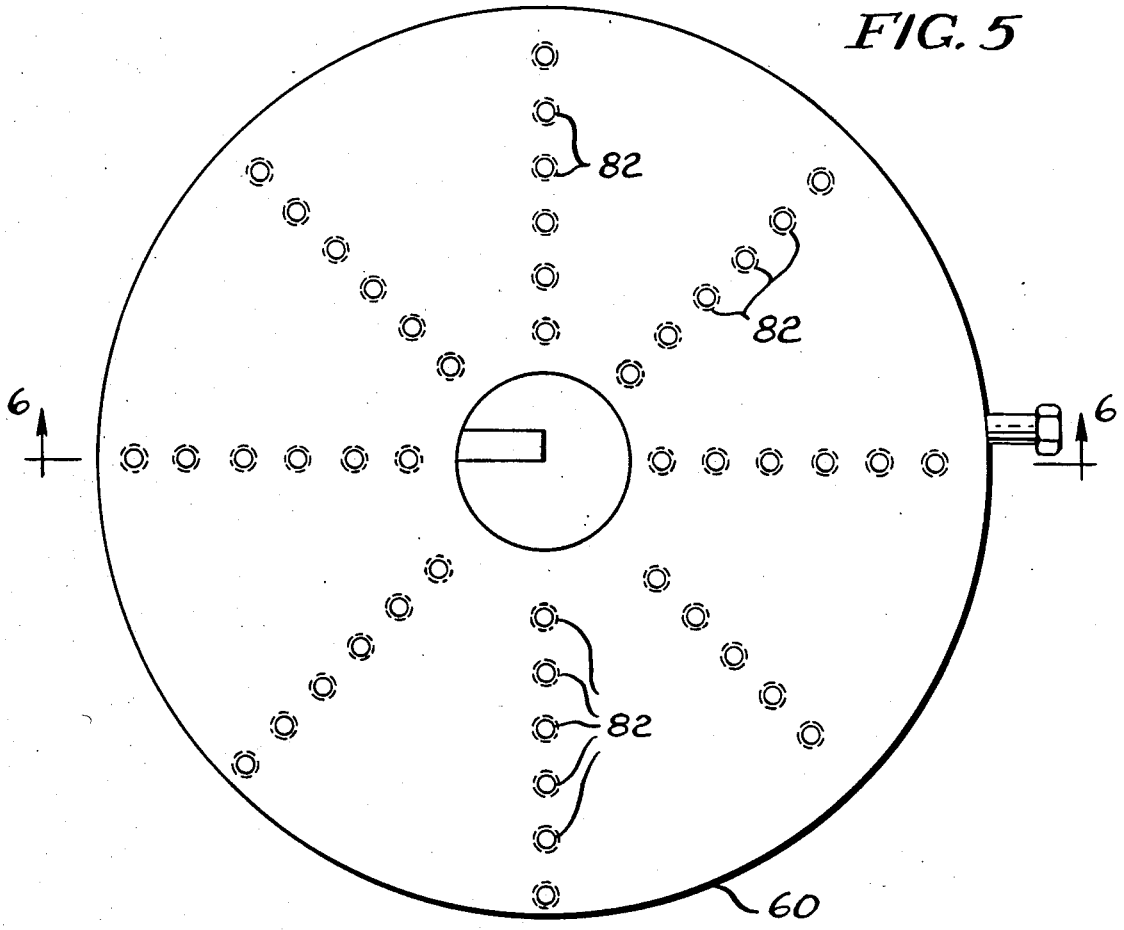
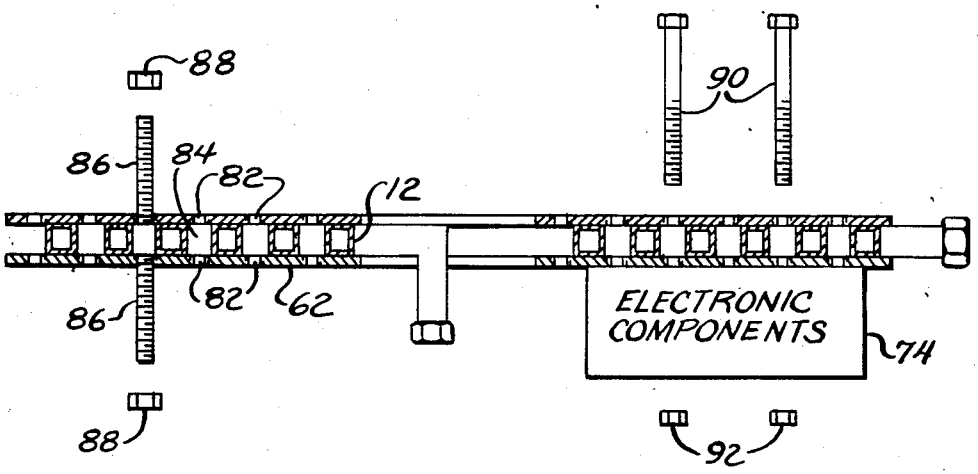
FIG. 6

FORCED FLOW EVAPORATOR FOR UNUSUAL GRAVITY CONDITIONS

The invention described herein was made in the performance of work under NASA Contract No. NAS 9-17195 and is subject to the provisions of Section 305 of the National Aeronautics and Space Act of 1958 (72 Stat. 435, 42 USC 2457).

FIELD OF THE INVENTION

This invention relates to evaporators, and more particularly, to evaporators that may be used with efficacy in unusual gravity conditions as, for example, zero gravity conditions encountered by spacecraft or in vehicles, such as high performance aircraft, that are subject to multiple "G" loads at various times during their operation.

BACKGROUND OF THE INVENTION

Various vehicles, such as spacecraft and aircraft carry a substantial quantity of electronic gear necessary to assure proper operation of the craft. During operation of the electronic gear, substantial quantities of heat are generated and to protect the equipment, it is necessary that some means be provided for cooling the equipment.

Cooling can be obtained by flowing a coolant in heat transfer relation to the heat load to be cooled with the heat load rejecting heat to the coolant which rises in temperature and elsewhere in the system has the acquired heat rejected. While such cooling can be effected without changing the phase of the coolant, as is well known, substantially greater quantities of heat can be exchanged for a given coolant flow where the coolant undergoes a phase change, normally from the liquid phase to the vapor phase since, in addition to whatever heat is taken up by a change in temperature of the coolant, the generally much greater heat of vaporization is also taken up from the heat load.

While many proposals have been made for cooling various heat loads such as electronic gear by evaporation, most are not susceptible to ready employment in unusual gravitational conditions as are encountered by spacecraft or high performance aircraft at various times in their operation.

In the case of zero gravity conditions, such as are encountered by spacecraft, the liquid phase of the coolant will literally float within its flow path within an evaporator without necessarily coming into good heat transfer relationship with an evaporator boundry or wall through which heat transfer must occur. Consequently, the rate of heat transfer to the liquid phase may be substantially impeded reducing the thermal efficiency of the evaporator.

In the case of high gravitational loading as is encountered in high performance aircraft, particularly when undergoing abrupt changes in attitudes or performing aerobatic maneuvers, the large forces involved will be applied to the liquid phase of the coolant and drive the same against some part of the heat transfer boundry of the evaporator leaving other parts of the boundry literally starved of the liquid phase of the coolant to be evaporated thereat. Again, heat transfer efficiency can be considerably lowered.

The present invention is directed to overcoming one or more of the above problems.

SUMMARY OF THE INVENTION

It is the principal object of the invention to provide a new and improved method of evaporative cooling and to provide a new and improved cooling system including an evaporator for use in unusual gravitational conditions.

More specifically, it is an object of the invention to provide a method and system wherein the heat transfer boundry of an evaporator is properly wetted with coolant in the liquid phase without regard to the presence or absence of low or zero or relatively high gravitational forces.

According to one aspect of the invention, there is provided a method of cooling which includes the steps of providing an evaporator including a generally spiral shaped conduit having opposite ends and placing a heat load to be cooled in heat transfer relation with the conduit. A vaporizable coolant is introduced into one of the conduit ends at least in partly the liquid phase. The coolant is flowed through the conduit while at least part of the liquid phase is evaporated by transfer of heat from the heat load to the conduit. The coolant is removed from the conduit at the other end at least partly in the vapor phase.

The flow of the coolant through the spiral-shaped conduit generates centrifugal force which causes the liquid phase coolant to move radially outwardly within the conduit and impinge against the radially outer interior wall of the conduit. Vortices generated by flowing vapor phase coolant circulate the liquid phase along the entirety of the inner wall of the conduit to wet the entirety of the wall to maximize efficiency of evaporation operation.

According to a preferred embodiment of the invention, the temperature of the evaporator is regulated by the step of regulating the pressure of the coolant within the conduit.

In a highly preferred embodiment, the conduit is generally planar and heat loads are placed on each side of the plane defined thereby. Thermally conductive material may be interposed between the conduit and the heat loads on each side of the plane to facilitate heat transfer from the load to the conduit.

In a highly preferred embodiment, phase change material may be placed in heat transfer relation with both the conduit and the load where the heat loading of the system is such as to vary substantially. For relatively low heat loading, the phase change material will tend to assume, for example, the solid phase while rejecting heat to the conduit. For high heat loading on the system, the phase change material will, for example, tend to assume the liquid phase thereby absorbing heat from the heat load to supplement the cooling provided by evaporation.

According to this aspect of the invention, the coolant and the phase change material serve to absorb heat during high heat loading. The phase change material is reconditioned to absorb heat during low heat loading of the system.

The invention also contemplates an evaporative cooling system for use in unusual gravitational conditions including an evaporator having a generally spiral-shaped conduit with an interior wall. Means are provided for mounting a heat load in heat transfer relation on the exterior of the conduit. A refrigerant that may exist in the vapor phase, the liquid phase or mixtures thereof is employed in the system. Means are utilized for circulating the refrigerant (a) at least partly in the liquid phase to the conduit and (b) at least partly in the vapor phase from the conduit. The circulation is such that the refrigerant will exist in the conduit principally as a two phase mixture of liquid and vapor with the proportion of liquid to vapor progressively decreasing as the refrigerant flows through the conduit. The flow rate of the vapor in the two phase mixture is such as to cause the liquid to be centrifuged to and circulate on the interior wall of the conduit.

In a preferred embodiment, the conduit is defined by a wound tube.

In a highly preferred embodiment, the tube has a rectangular cross section with radially inner and outer sides and opposed axially facing sides. Thermally conductive plates are disposed on each of the axially facing sides and provided with mounting means oppositely of the associated axially facing side.

The invention also contemplates that the conduit have plural convolutions with the radially inner and outer sides on adjacent convolutions being spaced to define a phase change material receiving pocket; and phase change material is disposed in said pockets.

The invention further contemplates an evaporator of the type mentioned previously along with means for introducing a coolant in the liquid phase or in a mixture of liquid and vapor phases into an inlet to the conduit and for causing the coolant to flow through the conduit towards an outlet therefrom while evaporating some or all of the liquid phase so that the coolant emerges from the outlet in the vapor phase or as a mixture of liquid and vapor phases. Means are provided that are associated with the conduit for controlling the pressure of the coolant therein to thereby set the saturation temperature of the system.

Other objects and advantages will become apparent from the following specification taken in connection with the accompanying drawings.

DESCRIPTION OF THE DRAWINGS

FIG. 1 is a schematic of an evaporative cooling system made according to the invention;

FIG. 2 is a somewhat schematic, sectional view of occurrences taking place within an evaporator made according to the invention;

FIG. 5 is a plan view of the evaporator;

FIG. 6 is a sectional view of the evaporator taken approximately along the line 6—6 in FIG. 5;

DESCRIPTION OF THE PREFERRED EMBODIMENT

Figure 3:
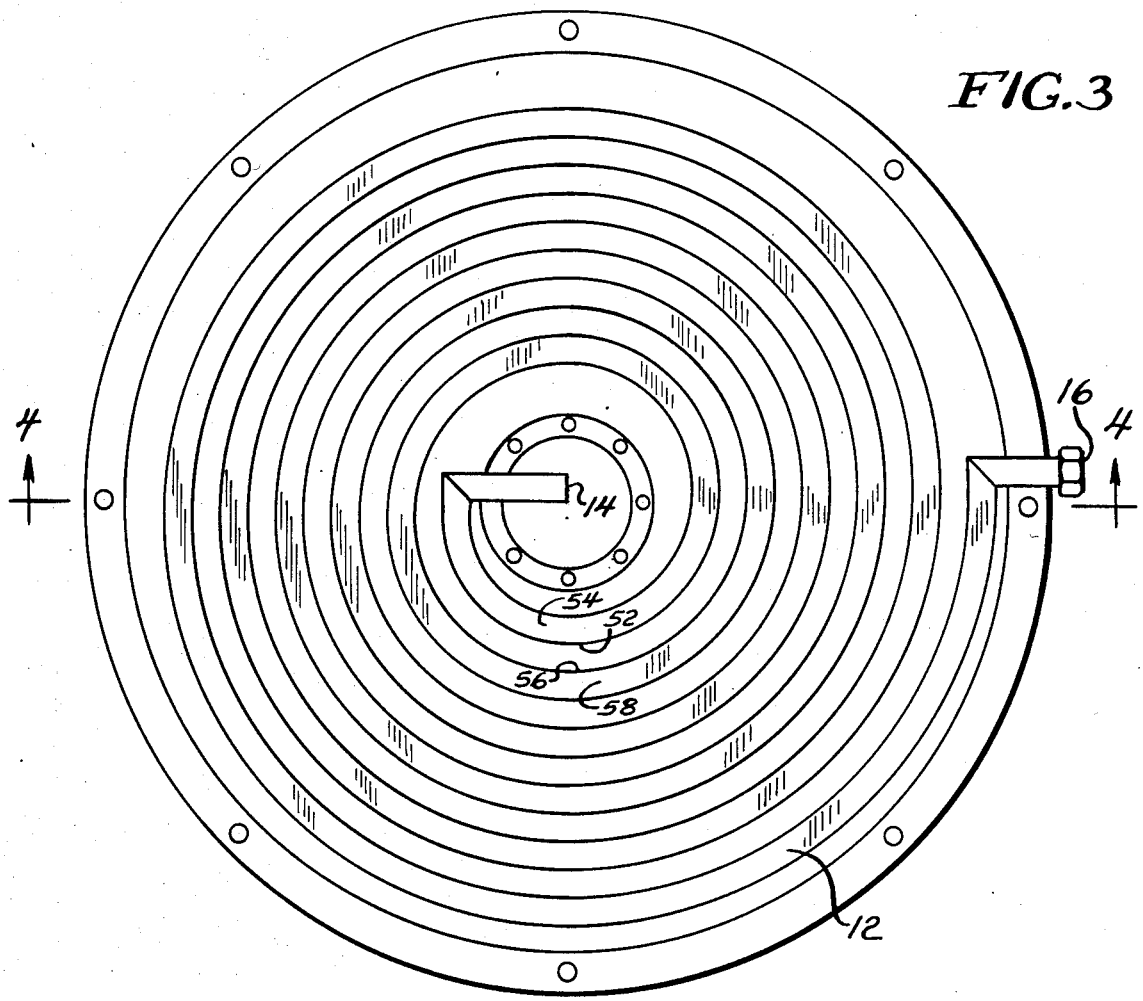
FIG. 3 is a sectional view taken approximately along the line 3—3 in FIG. 4.
Figure 4:
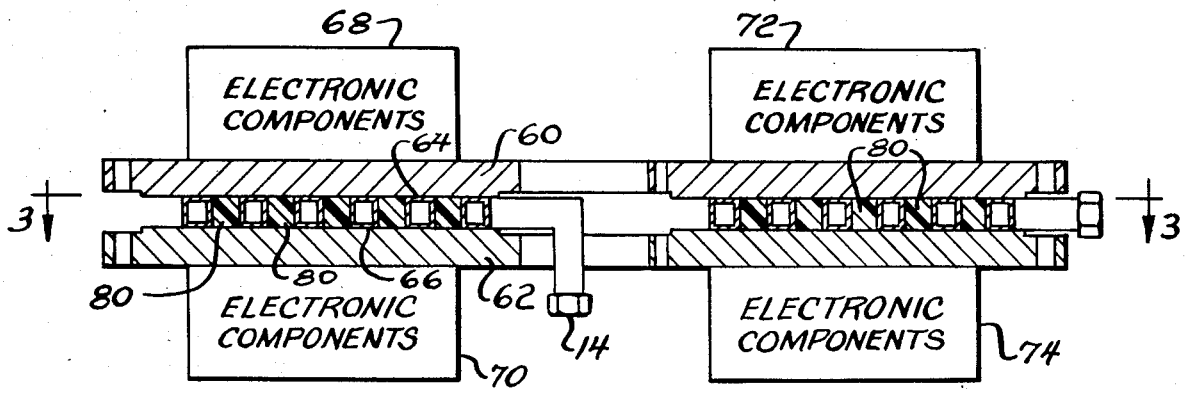
FIG. 4 is a sectional view taken approximately along the line 4—4 in FIG. 3.

An exemplary embodiment of an evaporative cooling system made according to the invention is illustrated in FIG. 1 and is seen to include an evaporator, generally designated 10. As will be explained in greater detail hereinafter, the evaporator includes a conduit 12 which is spiral-shaped and which is generally planar. The conduit 12 includes an inlet 14 and an outlet 16. As illustrated in FIG. 1, the inlet 14 is radially inwardly of the outlet 16 but it is to be noted that the arrangement could be reversed without deleteriously affecting system performance; and the invention expressly contemplates that reversal of the location of the inlet 14 and outlet 16 may even be advantageous in some instances. A pair of heat loads 18 and 20 are provided, one for each side of the plane defined by the conduit 12 and each is placed in good heat transfer relation with the conduit 12 by means schematically shown at 22 and 24 respectively. In actuality, each heat load 18 and 20 can be made up of a plurality of differing heat generating components as opposed to a single heat generating component.

A refrigerant or coolant input line 26 is connected to the inlet 14. By means of the line 26, a vaporizable coolant of the type that may exist in the liquid phase, the vapor phase, or as a mixture of liquid and vapor phases is provided to the evaporator. According to the invention, the incoming stream of coolant on the line 26 will be at least partly in the liquid phase. The degree to which the coolant is in the liquid phase will be dependent upon other system parameters. For example, if the coolant is used for other cooling purposes as, for example, in heat exchangers 28 upstream of the inlet 14 prior to being directed to the evaporator 10 for further cooling purposes, in most instances, the incoming coolant at the inlet 14 will be in the form of a mixture of liquid and vapor phases. Conversely, if the coolant stream is first applied to the evaporator 10, it will generally be predominantly or wholly in the liquid phase and may even be subcooled below the boiling point of the coolant for the system pressure of concern.

Typical examples of coolants that may be employed include those sold under the registered trademark "Freon" and ammonia, the former being preferred for aircraft applications and the latter being preferred for spacecraft applications.

The system may include a pump 30 at any of a variety of locations.

A source of refrigerant is also included. The source of refrigerant may be a storage vessel such as schematically shown at 32 or may be recirculated refrigerant on a line 34 from the output of a condensor 36 or a combination of both.

The outlet 16 of the evaporator 10 is connected to a pressure regulator 38 which is adapted to regulate the pressure within the evaporator 10 to thereby control the evaporator temperature by setting the boiling point of the coolant. Where coolant is to be recirculated, the pressure regulator 38 is connected to, for example, the condensor 36.

Coolant emerging from the evaporator 10 at the outlet 16 will be in the vapor phase or as a mixture of vapor and liquid phases. To the extent the evaporator 10 is subjected to heat loading by the loads 18 and 20, the proportion of the coolant in the liquid phase will decrease as the coolant progresses from the inlet 14 to the outlet 16. Whether the coolant emerges wholy in the vapor form or as a mixture of vapor and liquid phases is dependent upon overall system design. For example, if heat exchangers (not shown) similar to the heat exchangers 28 are interposed between the evaporator 10 and the condensor 36, the system would be made such that the coolant would emerge from the outlet 16 as a mixture of liquid and vapor phases. However, where heat loads downstream of the outlet 16 are not employed, the coolant may emerge from the outlet 16 wholly in the vapor form and possibly in the form of superheated vapor.

In operation, the flow of coolant through the evaporator 10 and the conduit 12 thereof is such as to generate substantial centrifugal force as a result of flowing in a spiral-shaped path and through the several convolutions thereof defined by the conduit 12. As a consequence, coolant in the liquid phase, being more dense than coolant in the vapor phase, will move radially outwardly to impinge upon the radially outer wall of the conduit 12. It has been determined that once liquid phase coolant strikes the radially outer wall of the conduit 12, it will tend to flow around the conduit interior to the radially inner wall as well to provide a uniform film of liquid phase coolant which boils uniformly.

As indicated somewhat schematically in FIG. 2, an annular flow regime exists as the coolant passes through the spiral conduit 12. The flow pattern includes a high speed core of vapor flow depicted by an arrow 40 of substantial length and surrounded by an annular liquid film on the interior of the conduit which is travelling at a lower speed than the vapor core. The low speed of the liquid flow is depicted by a relatively short arrow 42. It has been found that the annular flow persists to a very high quality and that any entrained liquid in the vapor is essentially centrifuged to the radially outer or "pressure" wall 44 of the conduit 12. However, rather than accumulating and stratifying on the radially outer wall 44 of the conduit 12, a secondary vapor flow comprised of counterrotating vortices, generally designated 46 and 48, tend to circulate the liquid film from the radially outer wall to the radially inner wall 50 or "suction side" of the conduit 12 and form a thin annular film of liquid phase coolant about the entire inner surface of the conduit 12.

This annular film boils off uniformly absorbing heat about the entire periphery of the cross section of the conduit 14 to provide highly efficient heat transfer notwithstanding the existence of unusual gravitational conditions.

For example, in zero gravity situations as encountered by spacecraft, the centrifugal force provided by the vapor flow brings the liquid phase coolant into contact with the wall 44 and the above described uniform film occurs as a result.

In the case of high gravitational loads, the system may be designed such that the vapor flow rate will be such as to generate counterrotating vortices 46 and 48 of sufficient strength to circulate the liquid from whichever wall of the conduit 12 becomes the pressure wall during the imposition of high gravitational loading. In this connection, use of the invention under high gravitational condition will most frequently occur in high performance aircraft undergoing abrupt changes in attitude or direction. So while in usual operation the radially outer wall 44 will be the pressure wall, depending upon the nature of the maneuver being performed by the aircraft and the disposition of the evaporator 20 within such aircraft, some wall other than the wall 44 may become the pressure wall during such maneuver.

FIGS. 3–6 illustrate a preferred embodiment of an evaporator construction. As seen in FIG. 3, the conduit 12 is formed by a wound, metal tube having a rectangular cross section, specifically a square cross section. The conduit 12 is made up of a plurality of convolutions and it will be seen that the radially outer surface 52 of a convolution 54 is spaced from the radially inner surface 56 of the adjacent convolution 58.

The wound tube configuration is, as mentioned previously, generally planar and is sandwiched between two plates 60 and 62 of thermally conductive material. In this regard, the rectangular cross section is preferred since the flat, axially facing sides 64 and 66 of the tube forming the conduit 12 abut the respective plates 60 and 62 over a substantial area to enhance heat transfer between the plates 60 and 62 on the one hand and the tube forming the conduit 12 on the other.

The heat loads 18 and 20 are in the form of electronic component packages 68, 70, 72 and 74 are affixed to the plates 60 and 62 in good heat transfer relation therewith. Thus, heat generated in the components 68–74 travels through an associated one of the plates 60 and 62 to the axially facing walls 64 and 66 of the conduit 12 to be absorbed by the boiling film of coolant on the interior sides thereof. A portion of such heat will also flow to the radially inner and radially outer walls 56 and 52 by conduction and be absorbed by the boiling film on the interior of such walls.

Where the loading on the system varies during a cycle of operation as, for example, by turning on or turning off one or more of the electronic circuits associated with the components 68–74, the invention contemplates the use of so-called "phase change material" 80 disposed in the space or pockets between adjacent convolutions of the conduit 12. The phase change material 80 is in heat transfer contact with the plates 60 and 62 as well as the radially inner and radially outer walls 56 and 52 of the tubing of which the conduit 12 is formed. In a preferred embodiment, the phase change material is a paraffin type material as hexadecane, although other materials having the following characteristics could be used in lieu thereof.

The material used, at the temperatures prevailing in the evaporator 10, must be such as to tend to assume the solid phase for low heat loading on the system, that is, the same will give up accumulated heat to the conduit 12, and thus to the coolant therein, when the heat provided by the components 68–74 is at a low level insufficient to cause substantial evaporation of the coolant within the conduit 12. At the same time, the material 80 should tend to assume the liquid phase for a high heat load condition, absorbing heat from the heat loads during such an occurrence.

In the case of a low load condition, the heat of fusion of the material 80 will be yielded to the coolant while in the high heat loading condition, the heat of fusion of the material 80 will be absorbed from the heat loads. Thus, during low heat loads, the material takes advantage of excess cooling capacity in the evaporator 10 to provide the ability to act as a supplemental coolant during periods of high heat loading.

FIG. 5 illustrates radially extending lines of bores 82 in the plates 60 and 62. As seen in FIG. 6, the bores are aligned with each other and with spaces 84 between convolutions of the conduit 12. Studs 86 adapted to receive securing nuts 88 may be threaded into the bores 82 and utilized to anchor electronic components or other heat loads in good heat transfer relation to the plates 60 or 62. Alternatively, through bolts 90 may pass through the bores 82 and through a heat load such as the electronic component 74 to receive nuts 92 for securement purposes.

Figure 7:
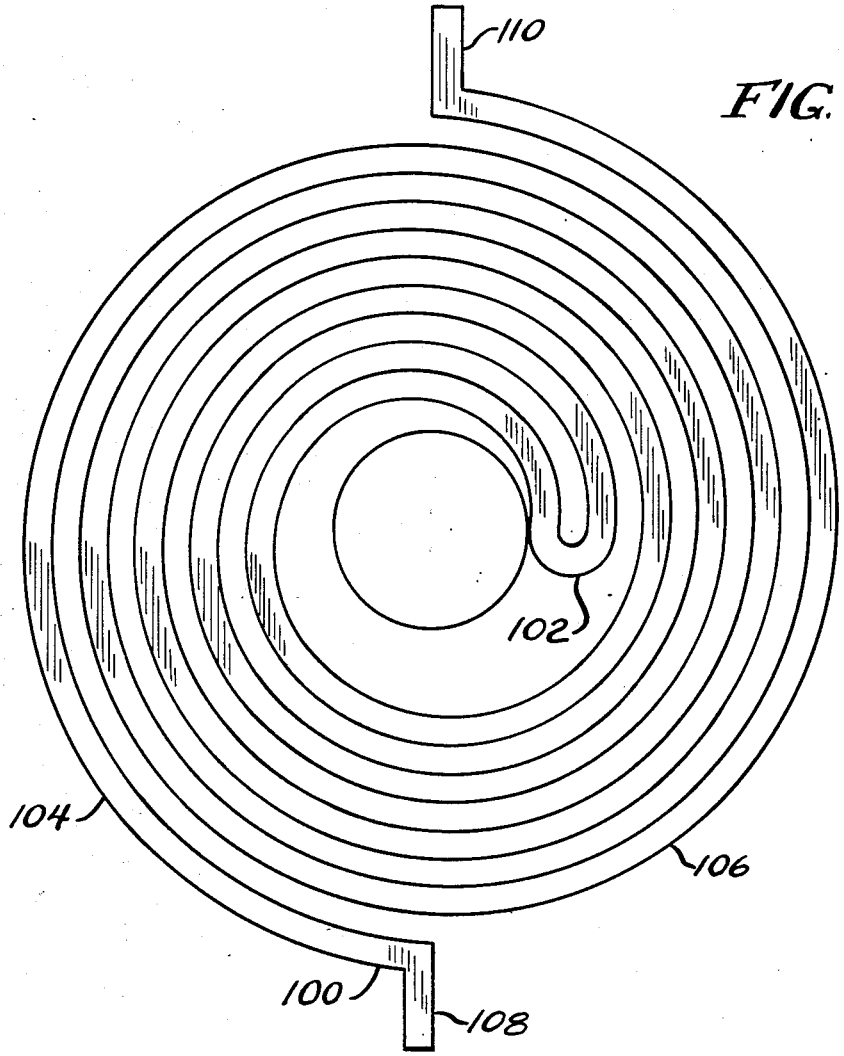
FIG. 7 is a view similar to FIG. 3 but illustrating a modified embodiment of an evaporator.

A modified embodiment of the evaporator is shown in FIG. 7. In FIG. 7, the evaporator conduit is designated 100 and like the conduit 12, has a rectangular cross section. However, unlike the conduit 12, the tube 100 has a reverse bend 102 near the center of the spiralled configuration so as to essentially define two interleaved spirals 104 and 106 interconnected by the reverse bend 102. The spiral 104 terminates at a radially outer port 108 while the spiral 106 terminates in a radially outer port 110. The ports 108 and 110 serve as the inlet and outlet for the conduit 100.

In addition to operating as a cold plate evaporator, the invention contemplates that the previously described structure can be used with sensible or condensing heat streams. In the case of either, the method of heat transfer can be direct or indirect.

Figure 8:
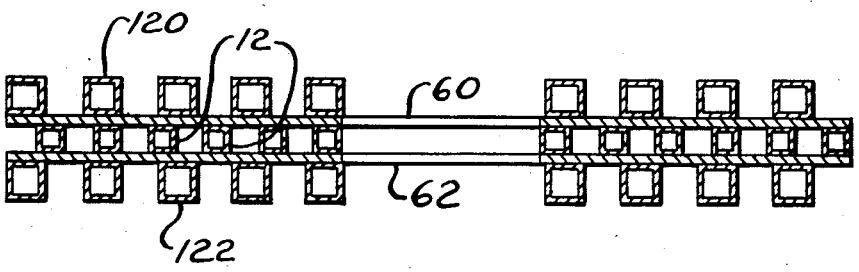
FIG. 8 is a view similar to FIG. 4 but showing a further modified embodiment of an evaporator of the indirect heat transfer type.
Figure 9:
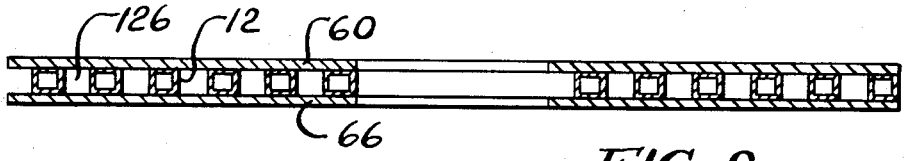
FIG. 9 is a view similar to FIG. 8 but showing a modified embodiment adapted for direct heat transfer.
Figure 10:
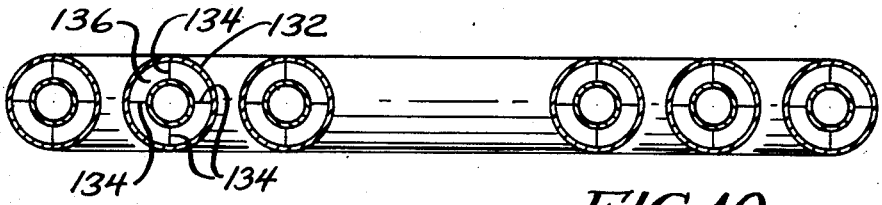
FIG. 10 is a view similar to FIG. 9 but of a modified embodiment of a direct heat transfer evaporator.

FIG. 8 illustrates a structure that may be used with either sensible or condensing heat streams and employs an indirect method of heat transfer. In this embodiment, the heat loads 68, 70, 72 and 74 are replaced with conduits 120 and 122, the conduit 120 being in heat transfer contact with the plate 60 and the conduit 122 being in heat transfer contact with the plate 62. The conduits 120 and 122 can take on any desired geometric shape but typically will be spirally wound of tubing having a rectangular cross section. A fluid to be condensed may be circulated within the conduits 120 or 122, yielding heat by indirect heat transfer through the plates 60 and 62 to the vaporizable coolant contained with the conduit 12. Alternatively, a fluid whose temperature is to be lowered without undergoing a phase change may be circulated through the conduit 120 and 122, rejecting heat to the vaporizable coolant contained in the conduit 12 by indirect heat transfer through the plates 60 and 62.

Where direct contact heat transfer is desired, the embodiments of FIGS. 9 or 10 may be employed. In the embodiment shown in FIG. 9, the plates 60 and 62 are retained as is the conduit 12. However, the phase change material 80 in the interstices between adjacent convolutions of the conduit 12 is removed and suitable seals (not shown) employed to delineate a spiral shaped passage 126 between the convolutions of the conduit 12. The fluid to be condensed or cooled is then circulated within the passage 126 thus defined.

The embodiment of FIG. 10 contemplates a spirally wound tube 130 of generally circular cross section which is contained within a similarly wound tube 132 of larger diameter. Spacers shown schematically at 134 may serve to center the tube 130 within the tube 132.

Vaporizable refrigerant is circulated within the tube 130 in the same fashion as in the conduit 12. The fluid to be condensed or cooled is circulated within the annular space 136 existing between the tube 130 and 132 to achieve direct cooling.

Figure 11:
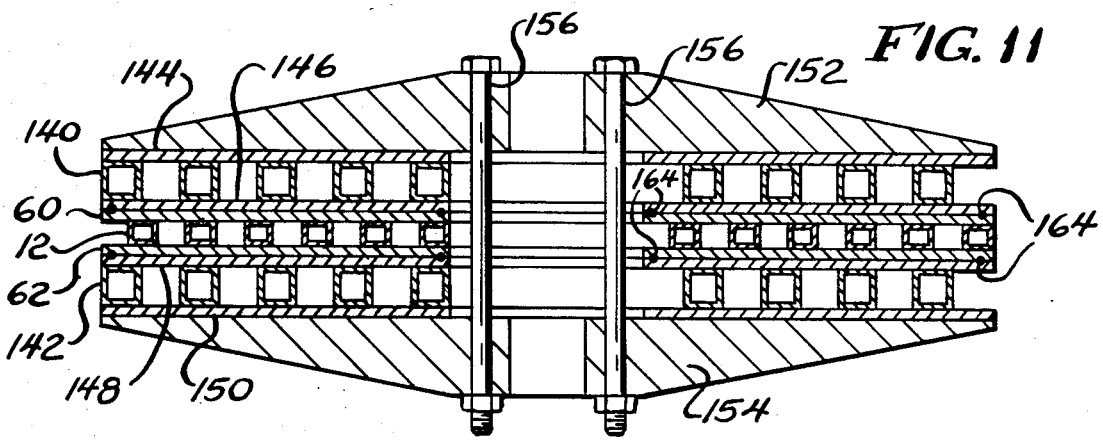
FIG. 11 is a view of an evaporator made according to the invention in a clamping device.
Figure 12:
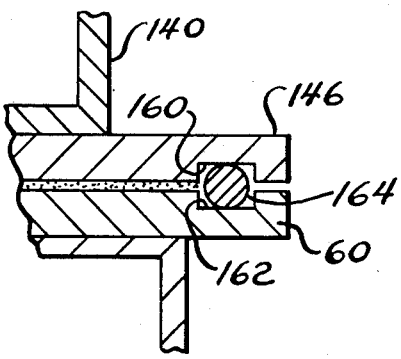
FIG. 12 is an enlarged, fragmentary sectional view of a portion of the embodiment shown in FIG. 11.

It will be appreciated that an evaporator made according to the invention will have substantial strength. As a consequence, it can be employed in stacks including a large number of the coils forming the conduit 12. As seen in FIG. 11, the conduit 12 is retained along with the plates 60 and 62. Additional spirally coiled conduits 140 and 142 are also employed in the stack. The coiled tube 140 is received and sandwiched between plates 144 and 146 while the tube 142 is similarly sandwiched between plates 148 and 150. Clamps 152 and 154 are applied to the stack and held in assembled relation by clamp bolts 156. The interfaces between the plate 60 and the plate 146 on the one hand and the plate 62 and the plate 148 on the other can be dry or provided with a highly thermally conductive grease. FIG. 12 shows the use of such grease at 158. When this embodiment is employed, the radially outer and inner perimeters of the involved plates are provided with axially opening facing grooves 160 and 162 for receipt of O-ring seals 164 to assure that the grease 158 is contained at the interface.

From the foregoing, it will be appreciated that an evaporative cooling system made according to the invention is ideally suited for use in environments subject to unusual gravitational conditions. By making use of the counterrotating vortices induced by the relatively higher rate of vapor flow through a spirally formed tube, all interior sides of the tube may be wetted with liquid phase coolant to provide highly efficient heat transfer while impingement of liquid phase coolant on at least one wall of the evaporator conduit is assured by taking advantage of the centrifugal force induced by vapor flow in the spiralled conduit.

Furthermore, it will be appreciated that an evaporator made according to the invention is quite flexible in terms of the number of uses and types of heat transfer in which it may be used with efficacy.

We claim:

1. A cooling system for zero or high gravity application comprising:

an evaporator including a generally spirally wound, plural convolution conduit having an inlet and an outlet;

a pair of thermally conductive plates sandwiching said conduit and in heat transfer relation therewith;

means on each of said plates oppositely of said conduit for securing components to be cooled to said plates on both sides of said conduit;

means for introducing a coolant in the liquid phase or a mixture of liquid and vapor phases into said inlet and for causing said coolant to flow through said conduit toward said outlet while evaporating some or all of said liquid phase so that the coolant emerges from the outlet in the vapor phase or as a mixture of liquid and vapor phases; and means associated with said conduit for controlling the pressure of the coolant therein to thereby set the saturation temperature of the system.

2. The cooling system of claim 1 wherein at least some of the adjacent convolutions of said conduit are spaced, and further including phase change material in the spaces between said some convolutions, said phase change material assuming on phase for low heat loading on said system while yielding heat to said coolant and assuming another phase for high heat loading on said system while absorbing heat from components secured to said plates.

3. A method of cooling in unusual gravity conditions comprising:

(a) providing a evaporator including a generally spiral shaped conduit having opposite ends;

(b) placing a heat load to be cooled in heat transfer relation with said conduit;

(c) introducing a vaporizable coolant at least partly in the liquid phase into one of said conduit ends;

(d) flowing the coolant through the conduit while evaporating at least part of the liquid phase by transfer of heat from the heat load to the conduit; and (e) removing the coolant from the conduit other end at least partly in the vapor phase wherein said spiral shaped conduit is generally planar and step (b) includes placing a heat load on each side of the plane defined thereby.

4. The method of claim 3 further including the step of regulating the pressure of the coolant within the conduit.

5. The method of claim 3 wherein thermally conductive material is interposed between said conduit and said heat loads on each side of said plane.

6. The method of claim 3 further including the step of placing phase change material in heat transfer relation with both said conduit and said load.

7. A cooling system for zero or high gravity application comprising:

an evaporator including a generally spiral shaped conduit having an interior wall;

means for mounting a heat transfer plate in heat transfer relation on the exterior of said conduit;

a refrigerant that may exist in the vapor phase, the liquid phase and mixtures thereof;

a condenser for said refrigerant; and means for circulating refrigerant (a) at least partly in the liquid phase from said condensor to said conduit and (b) at least partly in the vapor phase from said conduit to said condenser, the circulation being such that the refrigerant will exist in said conduit principally as a two phase mixture of liquid and vapor with the proportion of liquid to vapor progressively decreasing as the refrigerant flows through the conduit, the flow rate of the vapor in the two phase mixture being such as to cause the liquid to be centrifuged to and circulate on said interior wall of the conduit.

8. The cooling system of claim 7 wherein said conduit is defined by a wound tube.

9. The cooling system of claim 7 wherein said conduit has plural convolutions and the radially inner and outer sides on adjacent convolutions are spaced to define phase change material receiving pockets; and phase change material in said pockets.

10. A cooling system for zero or high gravity application comprising:

an evaporator including a generally spiral shaped conduit having an interior wall;

means for mounting a heat transfer in heat transfer relation on the exterior of said conduit;

a refrigerant that may exist in the vapor phase, the liquid phase and mixtures thereof; and means for circulating refrigerant (a) at least partly in the liquid phase to said conduit and (b) at least partly in the vapor phase from said conduit, the circulation being such that the refrigerant will exist in said conduit principally as a two phase mixture of liquid and vapor with the proportion of liquid to vapor progressively decreasing as the refrigerant flows through the conduit, the flow rate of the vapor in the two phase mixture being such as to cause the liquid to be centrifuged to and circulate on said interior wall of the conduit.

11. The cooling system of claim 10 further including a heat load mounted in heat transfer relation to the exterior of said conduit.

12. The cooling system of claim 11 wherein said heat load comprises heat generating electronic components.

13. The cooling system of claim 11 wherein said heat load comprises a fluid conduit.

14. The cooling system of claim 10 wherein said mounting means comprises threaded fasteners.

15. The cooling system of claim 10 wherein said mounting means includes clamping means.

* * * * *